US012215429B2

(12) United States Patent
Eden

(10) Patent No.: US 12,215,429 B2
(45) Date of Patent: Feb. 4, 2025

(54) METHOD OF SEALING A SURFACE AND DEVICE THEREFOR

(71) Applicant: RAWWATER APPLIED TECHNOLOGY LIMITED, Cheshire (GB)

(72) Inventor: Robert Eden, Cheshire (GB)

(73) Assignee: RAWWATER APPLIED TECHNOLOGY LIMITED, Cheshire (GB)

( * ) Notice: Subject to any disclaimer, the term of this patent is extended or adjusted under 35 U.S.C. 154(b) by 0 days.

(21) Appl. No.: 17/254,781

(22) PCT Filed: Jun. 21, 2019

(86) PCT No.: PCT/GB2019/051752
§ 371 (c)(1),
(2) Date: Dec. 21, 2020

(87) PCT Pub. No.: WO2020/002886
PCT Pub. Date: Jan. 2, 2020

(65) Prior Publication Data

US 2021/0269908 A1 Sep. 2, 2021

(30) Foreign Application Priority Data

Jun. 25, 2018 (GB) ..... 1810419

(51) Int. Cl.
*C23C 4/123* (2016.01)
*C23C 4/08* (2016.01)

(52) U.S. Cl.
CPC ..... *C23C 4/123* (2016.01); *C23C 4/08* (2013.01)

(58) Field of Classification Search
CPC .. C23C 4/123; C23C 4/08; C23C 4/06; C23C 4/129; C23C 4/12; C23C 4/02
See application file for complete search history.

(56) References Cited

U.S. PATENT DOCUMENTS 2,092,150 A * 9/1937 Bleakley ..... B05B 7/203 239/83
2,968,083 A * 1/1961 Lentz ..... C04B 41/86 264/30
4,632,170 A * 12/1986 Pohl ..... C23C 4/123 118/302
4,751,113 A * 6/1988 Riccio ..... C23C 4/02 427/405
5,897,921 A * 4/1999 Borom ..... C23C 4/12 427/454

(Continued)

FOREIGN PATENT DOCUMENTS

CN 1570191 A 1/2005
GB 191005712 1/1911

(Continued)

OTHER PUBLICATIONS

UK Intellectual Property Office, Search Report for Application No. GB1819419.0, Oct. 9, 2018, 7 pages.

(Continued)

*Primary Examiner* — Katherine A Bareford
(74) *Attorney, Agent, or Firm* — Faegre Drinker Biddle & Reath LLP

(57) ABSTRACT

A method of sealing a surface is provided, the method comprising the steps of providing a metallic composition; providing a propellant; heating the metallic composition to above the melting point of the metallic composition to provide at least partially liquid metallic composition; accelerating the at least partially liquid metallic composition towards the surface by means of the propellant; and applying the at least partially liquid metallic composition to the surface.

23 Claims, 2 Drawing Sheets

(56) References Cited

U.S. PATENT DOCUMENTS

| | | | | |
|---|---|---|---|---|
| 6,623,808 | B1 | 9/2003 | Jordan et al. | |
| 6,746,225 | B1 | 6/2004 | McHugh | |
| 2002/0139528 | A1 | 10/2002 | Surjaatmadja | |
| 2006/0182375 | A1 | 8/2006 | Kraemer et al. | |
| 2008/0003251 | A1* | 1/2008 | Zhou | A61L 31/16 424/423 |
| 2008/0226879 | A1* | 9/2008 | Strock | C23C 4/12 106/676 |
| 2009/0214888 | A1* | 8/2009 | Upchurch | C23C 4/123 428/615 |
| 2015/0247475 | A1* | 9/2015 | Bischofberger | F01P 3/10 123/41.35 |

FOREIGN PATENT DOCUMENTS

| | | | |
|---|---|---|---|
| GB | 2343395 | A | 5/2005 |
| JP | S5561349 | A | 5/1980 |
| JP | 60-94677 | * | 5/1985 |
| JP | 64-65499 | * | 3/1989 |
| JP | 2015143394 | A | 8/2015 |
| WO | WO2009036520 | A1 | 3/2009 |

OTHER PUBLICATIONS

UK Intellectual Property Office, Search Report for Application No. GB1819419.0, Feb. 12, 2019, 4 pages.

International Search Report issued by the European Patent Office, dated Aug. 8, 2019, for International Patent Application No. PCT/GB2019/051752; 3 pages.

Written Opinion issued by the International Searching Authority, dated Aug. 8, 2019, for International Patent Application No. PCT/GB2019/051752; 6 pages.

International Preliminary Report on Patentability issued by the International Searching Authority, dated Dec. 29, 2020, for International Patent Application No. PCT/GB2019/051752; 7 pages.

* cited by examiner

METHOD OF SEALING A SURFACE AND DEVICE THEREFOR

CROSS-REFERENCE TO RELATED APPLICATIONS

The present application is a national stage entry of International (PCT) Patent Application Number PCT/GB2019/051752, filed Jun. 21, 2019, which in turn claims priority to Patent Application No. GB 1810419.0, filed Jun. 25, 2018, the subject matter of which is expressly incorporated herein by reference.

The present invention relates to sealing surfaces. In particular, the present invention relates to a method of sealing surfaces with a metallic composition, as well as apparatus therefor.

BACKGROUND

Surfaces may on occasion develop defects which require sealing. For example, surfaces may develop defects such as holes, cracks, fissures, fractures, failing of a joint, pores and punctures which prohibit the surface from functioning correctly. For example, pipes, tubes and/or containers may develop defects, such as cracks or holes, which require sealing to prevent leaks therefrom. Surfaces may also develop defects which require reinforcement or a protective seal. For example the surface of a container may become corroded or weakened during use, and require a protective seal and/or reinforcing to restore the integrity of the surface. A container may include a pipe, a vessel, a well, or any other container suitable for containing a volume of an at least partially liquid or fluid substance.

Surfaces may also require sealing, such that a coating across the entirety of the surface is provided. It may be desired to encapsulate a substance to prevent the matter which comprises the substance from escaping into the surrounding environment. For example, nuclear waste and/or radioactive materials may require sealing to form an encapsulating coating, such that hazardous material does not escape into the surrounding environment. Typically, sealing nuclear waste from the surrounding environment involves sealing the nuclear waste in cement blocks which in turn are held in steel containers, which in turn are then submerged in water. Such methods for dealing with hazardous waste are arduous and often expensive.

Many surfaces are difficult to seal. The surface may be, for example, in a subterranean location, submerged under water, or generally difficult to access. Furthermore, many surfaces are fragile, and as such, require sealing in a delicate manner, such that further damage is not caused to the surface. In addition, surfaces may be hazardous, for example, radioactive surfaces, nuclear waste surfaces, and biologically hazardous surfaces or contain hazardous materials. It is desirable to avoid contact of such hazardous surfaces or materials with the surrounding environment, to prevent contamination or damage to wildlife, humans, plants, and to the environment in general.

Current methods for sealing a surface are impractical for sealing surfaces that are difficult to access. In particular, current methods are not suitable for sealing a surface that is submerged under water. The surface is generally removed from the submerged area, and repaired or sealed under dry conditions.

Current methods for sealing a surface are also impractical for sealing surfaces that are fragile. In particular, current methods of sealing a surface employ high velocity sealants and/or sealants applied at high temperature, which may further damage the surface to be sealed.

Cold spraying involves accelerating heated solid micro particles towards a surface at very high velocities using a carrier gas. The heated, micro particles are accelerated at such a velocity that they plastically deform on impact with the surface. The deformed metal particulates bond mechanically with the surface, and with other metal particulates, to form a layer on the surface. Cold spraying has been used to deposit metallic layers. Cold spraying, however, has poor deposition efficiency, particularly for alloy powders. Furthermore, the size of the micro particles suitable (typically 1 to 50 micrometres) for cold spraying is limited to a narrow range, and depending on the type of micro particle used, supersonic velocities (typically 500 to 1000 m/s) are required to cause the required deformation on impact with the surface. Such high velocities are often created by heating the carrier gas to temperatures in excess of 800° C. As such, the extreme temperatures and velocities used in cold spraying often causes damage to the surface to be sealed, and is certainly unsuitable for fragile surfaces. Cold spraying is also only suitable for sealing surfaces under atmospheric conditions, and cannot be used under submerged aquatic conditions. This is because the velocity of the metal particulates is reduced as a result of friction with surrounding water, and furthermore the thermal energy of the particulates is dissipated into the surrounding water before the micro particles hit the surface. As such, the micro particles cool in the water, lose their elasticity (ability to deform on impact), and thus simply bounce off the surface to be coated.

Surfaces may also be dirty and require cleaning prior to sealing. However, cleaning an inaccessible surface, such as those in subterranean locations or submerged locations, is difficult. Dirty or grimy surfaces may compromise the integrity of the seal formed on the surface. It is therefore desirable to clean the surface before providing a seal to the surface.

There is, therefore a need for a method and suitable apparatus for sealing surfaces which addresses one or more of the aforementioned problems.

SUMMARY OF INVENTION

According to a first aspect of the present invention, there is provided a method of sealing a surface comprising: providing a metallic composition; providing a propellant; heating the metallic composition to above the melting point of the metallic composition to provide at least partially liquid metallic composition; accelerating the at least partially liquid metallic composition towards the surface by means of the propellant; and applying the at least partially liquid metallic composition to the surface.

The method according to the first aspect of the present invention allows a spray of at least partially liquid metal to be directed to a surface. Upon contact with the surface, the liquid metallic droplets will deform and cool. As the droplets cool, they will solidify on the surface forming a coating. The coating will reinforce and/or seal the surface onto which the stream of metallic droplets is directed. The stream of metallic droplets may be moved across the surface in order to coat a larger area of the surface. Multiple passes may be made over the surface in order to increase the thickness of the deposited metallic composition. Preferably the droplets of the metallic composition are entirely liquid.

The method may advantageously seal a leak in a surface. The leak may be an active leak in which fluid, such as liquid or gas, for example water, is moving through a defect in a surface or joint. The fluid may comprise a gas at ambient temperature, for example air. The fluid may comprise a liquid at ambient temperature for example water and/or hydrocarbons. The leak may be a passive leak in which fluid is not passing through a defect, but would do so if fluid was present. According to the method of the present invention, a leak in a surface may be sealed in an environment surrounded by a fluid, such as liquid or gas. For example, the leak may be sealed in an atmospheric environment (e.g. in the presence of air), or may be sealed in an aquatic environment (e.g. under water). Advantageously, the molten metallic composition may be applied to the surface and/or surface defect at a temperature less than the ignition temperature of a hydrocarbon fuel, for example at a temperature less than 280° C. for gasoline, and at a temperature less than 210° C. for diesel, in particular where the leaking fluid comprises hydrocarbons.

The surface may at least partially define a volume containing an at least partially liquid or fluid substance. The volume may be defined by a container comprising the surface, such as pipes, vessels, wells and the like. Current methods for sealing a surface from which an at least partially liquid substance is leaking are also impractical. Current methods often require isolation of the flow of the leak before sealing the surface defect giving rise to the leak. For example, the leak may be isolated through the use of stop valves upstream of the location of the surface defect giving rise to the leak. Where the substance that is escaping through the surface defect is hazardous it may be impractical to isolate the leak. The substance that is escaping through the surface defect may be escaping at high velocity. As such it is desirable to seal the surface defect as quickly as possible to minimise any contamination of the surrounding environment.

Current methods for sealing a surface are also impractical for sealing surface defects into which allow a substance there into. For example, a surface defect may allow a substance to penetrate the surface defect, and to enter a volume at least partially defined by the surface (e.g. a container surfaces, such as a pipe surface). For example, if a container comprising the surface is at least partially submerged in water, the container may flood if a surface defect allows water to penetrate there into. The water may enter the container through the surface defect at high velocity, and there are no means available for isolating the ingress of water into the container. Said container, could, for example be the hull of a boat or a container housing hazardous waste.

As such, there is a need for a method of sealing 'active' leaks, that is to say leaks which cannot be isolated, and as such the leak is dynamic.

In some embodiments, the surface to be sealed comprises at least one surface defect to be sealed. The at least one surface defect may be one or more of holes, cracks, fissures, fractures, failings of a joint, pores, punctures and the like. Alternatively or additionally, the surface defect may be a site of corrosion or weakening of the surface, which may require reinforcing by providing a seal according to the present invention.

In some embodiments, the surface at least partially defines a volume defining a container. Containers according to the present invention may include pipes, vessels, wells, and the like. Preferably, the container volume comprises an at least partially liquid or fluid substance, and a surface of the container comprises at least one surface defect, wherein the at least one surface defect is the source of a leak from which matter comprising the at least partially liquid or fluid substance may escape. The escapement of such matter may be considered to be an "active" leak. Of course, the skilled person will appreciate that in some embodiments, the at least partially liquid or fluid substance is outside of the container volume, and that where a surface defect is present, the at least partially liquid or fluid substance may penetrate through the surface defect and into the container volume. It will be appreciated that the present invention may be used to repair gas leaks or liquid leaks. Whilst the present invention is described for the sake of convenience as a liquid leak, it should be understood that it is equally applicable to gas leaks.

Preferably, the surface to be sealed is at least partially submerged in an aqueous fluid. Aqueous fluids may include water, saline, sea water, mixtures of oil and water, and the like. Alternatively, the surface to be sealed may be at least partially submerged in a non-aqueous fluid, such as oil. In some embodiments of the present invention, the surface to be sealed is at least partially submerged in water, preferably submerged under water. As such, the present invention may be directed to a method of sealing a leak. In such a context sealing a surface comprises sealing a leak in the surface.

Preferably, the method further comprises heating the propellant. The propellant may be heated by any suitable means as is known in the art. For example, the propellant may be passed over one or more heated elements, in a similar way to how the air is heated in a hairdryer.

The metallic composition may be heated by contacting the metallic composition with the heated propellant. As such, the propellant is preferably heated to above the melting point of the metallic composition. In this way, no separate heater for melting the metallic composition is required and it is the transfer of heat from the heated propellant to the metallic composition which melts the metallic composition.

Alternatively or additionally, the metallic composition may be heated otherwise than by contact with a heated propellant stream. For example, the metallic composition may be retained in a heated chamber. The heated chamber may be configured to allow molten metallic composition to enter the flow of propellant, thereby dispersing the molten metallic composition into droplets and entraining the droplets in the flow of propellant.

Instead of the whole or a large proportion of the metallic composition being melted, a stripe or wire of the metallic composition could be passed through a zone which is heated to above the melting point of the composition. For example, the metallic composition could be passed through the centre of an annular heating element arranged so that as the metallic composition is fed through the heating element, it is melted and the liquid metallic composition enters the flow of propellant.

In an embodiment, both the metallic composition and the propellant are heated. The temperature to which the metallic composition and the propellant are heated may be controlled independently. Where the spray of propellant and metallic composition is being used in a cold environment, the liquid metallic composition may solidify too quickly upon exposure to the cold environment. As such, it would be desirable to also heat the propellant in order to mitigate the cold environmental temperatures. Alternatively or additionally, the temperature of the metallic composition and/or propellant could be increased so that the metallic composition remains liquid for a longer time.

The method according to the first aspect of the present invention may further comprise the steps of: accelerating the propellant towards the surface and contacting the propellant with the surface prior to accelerating the at least partially liquid metallic composition towards the surface.

The propellant may be directed to the surface without containing any of the liquid metallic composition, namely only a stream of propellant is directed to the surface. This has a number of advantages. The surface may be contaminated with contaminants which would render the metallic composition unable to be retained on the surface. This may especially be the case underwater where organic matter may be deposited on the surface. Also, there may be loose debris on the surface which is needed to be removed before the metallic composition is applied. Thus, the propellant may be used to clean the surface.

Alternatively or additionally, the propellant may be used to change the temperature of the surface before the metallic composition is applied. The propellant may be used to heat the surface such that the metallic composition does not cool too quickly upon meeting the surface. The surface may be heated such that an area is defined that is hot enough for the metallic composition to remain liquid and flow across the surface. The metallic composition will flow across the surface until it reaches a portion of the surface which is cooler than the melting point of the metallic composition, which will define the edge of where the metallic composition will seal the surface. In this way, the area covered by the metallic composition may be controlled. Advantageously, the heated surface may contract on cooling, thereby exerting a pressure on the cooled and/or solidified seal. As such, the pressure exerted by the cooled and/or solidified surface may further strengthen the seal. For example, a surface comprising a hole may expand as the at least partially liquid metallic composition is applied, such that the diameter of the hole increases. On cooling, the diameter of the hole may decrease, thus exerting an inward pressure on the cooled or solidified metallic composition seal.

The method may also comprise the steps of providing a separate stream of propellant and directing the separate stream of heated propellant towards the surface during application of the at least partially liquid metallic composition to the surface.

The separate stream of propellant may be heated. In this way, the separate stream of propellant may be used to heat the surface which is being sealed. This allows greater control of where the metallic composition will be retained on the surface. The separate stream may be used to heat the deposited metallic composition to ensure that the individual droplets of the metallic composition are at least partially melted together.

In the method according to the present invention, the at least partially liquid metallic composition cools on contact with the surface to form a substantially unitary metallic composition seal. The at least partially liquid metallic composition at least partially melts previously applied solid metallic composition, coalesces with the previously applied solid metallic composition, and cools to form solid metallic composition. In this way, the individual droplets of molten metallic composition applied to the surface are able to combine with one another to form a continuous layer of the metallic composition.

The at least partially liquid metallic composition may be applied to the surface as a constant stream. In another embodiment, the at least partially liquid metallic composition may be applied to the surface intermittently.

The at least partially liquid metal composition is at a temperature no greater than 300° C., preferably no greater than 200° C., preferably no greater than 100° C. when it is accelerated towards the surface. Since the surface may be fragile, it is preferable to use low temperatures. In some embodiments, the metallic composition is applied to the surface at a temperature of between around 60° C. and around 200° C., preferably between around 70° C. and around 150° C., and preferably around 80° C. to around 120° C. As such, the melting point of the metallic composition needs to be no higher than the given temperatures.

The at least partially liquid metal composition may be accelerated towards the surface at a velocity no greater than around 150 m/s, preferably no greater than around 100 m/s, preferably no greater than around 50 m/s and more preferably no greater than around 25 m/s. It will be appreciated that the velocity may be higher in certain cases. Again, since the surface may be fragile, it is undesirable to use very high speeds as this may cause damage to the surface. In addition, very high speeds may result in the liquid metallic composition splattering away from the surface rather than remaining on the surface upon impact.

The propellant may provide sufficient propulsion to force the at least partially liquid metallic composition into deformations or defects in the surface. The deformations or defects may comprise one or more of cracks, fissures, punctures, and holes. Since the surface defects are unlikely to be smooth, it is desirable for the metallic composition to at least partially fill any defects in the surface to provide the strongest bond between the surface and the metallic composition once solidified. Otherwise, cavities may remain between the surface and the solidified metallic composition which could cause weakness or potential points of failure. By filling or covering any holes in a surface, leaks from the surface may be stopped.

The propellant may clean and/or heat the surface before the at least partially liquid metallic composition is applied. As discussed above, the propellant may clean the surface to allow the metallic composition to be more securely retained on the surface. Cleaning the surface to remove particulates, grime, dust, dirt and the like, improves binding of the metallic composition to the surface. The propellant may also be used to heat the surface to define an area which is warm enough for the molten metallic composition to not immediately solidify upon contact with the surface. Heating the surface provides a more uniform isotherm for heat dissipation upon contact of the at least partially liquid metal composition with the surface. As such, the cooling or solidifying of the liquid metal composition occurs at a more uniform rate, and an improved seal is provided.

The propellant is preferably gaseous, preferably a compressed gas. Preferably compressed gas may be provided in a compressed cylinder or be super-heated. The propellant may be a single gas or a mixture of gases. The propellant is preferably a gas which is unreactive to the metallic composition. The propellant may be, for example, nitrogen, air, or steam. In a preferred embodiment, the propellant is steam. Where the method of the present invention is used to seal a surface underwater, the propellant is preferably steam since the steam will cool in the water and will not form bubbles at the surface of the water. In contrast, if nitrogen or air were to be used as the propellant, these gases are not particularly soluble in water and would therefore bubble to the surface. In some circumstances, this may be acceptable and therefore nitrogen and/or air could be used. However, if the water contains radioactive species or otherwise potentially harmful contaminants, the production of bubbles at the surface may cause such dangerous pollutants to enter the air which could cause danger to the operator or otherwise environmental damage. Since steam will cool and reform water, there will be no bubbles formed at the surface of the water, resulting in a safer method of forming the seal.

The metallic composition may comprise a metal or a metal alloy. The metallic composition preferably has a melting point of below around 300° C. The metal alloy may be selected from the group consisting of bismuth alloys, indium alloys, antimony alloys, tin alloys, lead alloys and gallium alloys. The metallic composition preferably expands upon solidification. The metallic composition preferably comprises a bismuth alloy. As used herein, the term metal alloy will be understood to be an alloy containing one or more metals. For example, a bismuth alloy will be understood to be a bismuth-containing alloy, but may contain other metals. The metallic composition may be one of the compositions described in U.S. Pat. No. 6,474,414B1, particularly those described from column 3 line 8 to column 4 line 47. In one example, the metal alloy may comprise about 91 to 97% by weight bismuth and about 3 to 9% by weight silver. In another example, the metal alloy may comprise at least 50% by weight bismuth, 30 to 35% by weight tin, and 1.8 to 2.5% by weight antimony. In another example, the metal alloy may be as defined in the Applicant's co-pending GB Patent Application entitled "Improved Well Sealing Material and Method of Producing a Plug" filed on the same day as the present application.

It is preferable to use a metallic composition which expands upon cooling or solidifying as this provides improved sealing of cracks compared to materials which contract upon solidification. Since the metallic composition is applied to a surface in liquid form, if it were to contract upon solidification, it would pull away from the surface and therefore the sealing would be less effective. In contrast, according to the method of the present invention, having a metallic composition which expands upon cooling or solidifying results in a seal which does not move away from the surface upon solidification.

The at least partially liquid metallic composition preferably has a greater density than water, preferably a density greater than seawater, wherein said density is defined at 1 atm pressure and 25° C. Advantageously, where a surface defect that is submerged under water requires sealing, the metallic composition can displace the water from the surface defect, thus penetrating the defect efficiently to form an effective seal.

The surface to be sealed may be selected from the group consisting of: hazardous waste such as radioactive waste, nuclear waste, and biohazardous waste; oil and gas wellbores and pipelines; chemical refinery equipment; aircraft components such as aircraft fuselage and wings; military equipment; mining equipment; and marine vehicles such as submarines, ships and boats. The method of the present invention has particular application to the nuclear industry which requires dangerous materials to be contained for extended periods of time. The method of the present invention also has particular application to the maritime industry and/or to the disposal of waste in aquatic environments, where surfaces may be at least partially submerged under water. Metallic compositions which require very high temperatures and/or are reactive with water in their liquid state are undesirable for use under water due to the sometimes violent reaction with water.

The surface to be sealed may be submerged under water. This is particularly the case in the nuclear industry where potentially radioactive materials are stored under water. These materials may require sealing and/or reinforcement. The method of the present invention is particularly suitable for underwater use as the use of steam (or a highly water soluble gas, such as ammonia) reduces aerosol production on the surface of the water. No prior art sealing methods are suitable for underwater use. Advantageously, the at least partially liquid metallic compositions according to the present invention are directed to the surface comprising the surface defect, and the at least partially liquid metallic composition displaces the water within the surface defect. It will be appreciated that other fluids, such as hydrocarbons, may also be present in the surface defect and may also be displaced therefrom by the metallic composition.

The surface to be sealed may be 'actively' leaking. The matter comprising the substance that is leaking from the surface may be escaping at high velocity.

According to the method of the present invention, the at least partially liquid metallic composition may be applied to the periphery of the surface defect initially. As the metallic composition cools and forms a solid, the surface area of the surface defect is thus reduced. The application of the molten metallic composition may then continue to be applied to the solidified metal composition in a concentric matter, such that the surface area of the surface defect is successively reduced until a seal is formed. In preferred embodiments, the at least partially liquid metallic composition is applied to a surface defect in a spiral manner, beginning at or near to the periphery of the surface defect, and moving inwardly. The size of the surface defect causing the leak is thereby successively reduced, gradually stemming the flow of the leak until a seal is formed. In other words, the surface defect is increasingly occluded until the surface defect giving rise to the leak is sealed. Without wishing to be bound by theory, it is believed that as the surface defect is increasingly occluded, the velocity of the leak increases and the pressure decreases, according to Bernoulli's principle. It is believed that the reduction in pressure may draw the molten metallic composition into the surface defect, which subsequently cools on pre-deposited cooled and/or solidified metallic composition to seal the surface defect and provide a strong seal.

According to a second aspect of the present invention, there is provided an apparatus for sealing a surface comprising a metallic composition source; a propellant source switchably in fluid connection with the metallic composition source; a heat source configured to provide heat to the propellant and/or to the metallic composition to provide an at least partially liquid metallic composition; a nozzle in fluid connection with the metallic composition source and/or the propellant source, the apparatus being configured to expel a stream of at least partially liquid metallic composition and/or propellant from the nozzle.

The apparatus according to the second aspect of the present invention provides an apparatus which is able to provide a spray of liquid metallic droplets and direct them onto a surface. This allows a surface to be sealed in a quick and reliable manner. It is particularly suitable for repairing cracks in materials.

In the apparatus according to the second aspect of the present invention, the heat source may be provided by means of thermal conduction and/or by electrical means and/or by pyrotechnical means. The heat source may be used to heat the propellant and/or the metallic composition. There may be separate heat sources for the propellant and the metallic composition.

The nozzle may comprise a nozzle aperture. The shape of the nozzle may be any suitable shape. For example, the nozzle may be cone shaped, cylindrical shaped, cuboid shaped, and arcuate shaped. The nozzle aperture may be circular, rhombus or arcuate shaped. Indeed any suitable nozzle shape or nozzle aperture shape may be used. The shape of the nozzle or the nozzle aperture may be selected to provide different spray patterns. In some embodiments, the apparatus comprises two or more nozzles as described herein.

The apparatus according to the second aspect of the present invention may be a portable apparatus. For example, it is envisaged that the apparatus may be provided as a backpack which the user may carry. Advantageously, providing the apparatus in easily transportable form allows the user to access surfaces which are difficult to, or cannot be, moved.

According to a third aspect of the present invention, there is provided the use of a liquid bismuth alloy spray in sealing a surface. By applying a bismuth alloy in liquid form as a spray, this allows the alloy to fill any cavities, cracks, indentations or similar in a surface and then expand once in situ resulting in a very strong connection between the alloy and the surface. The application as a spray means that the alloy cools quickly on contact and does not require a mould or other retaining means to hold the alloy in place whilst it cools. Thus, the methods and apparatus of the present invention provides a simple and fast way of sealing a surface that does not require a means, such as a mould, to hold the alloy in place whilst it solidifies. Preferably, the liquid bismuth alloy is used to seal a leak.

According to a preferred embodiment of the third aspect of the present invention, there is provided the use of a liquid bismuth alloy spray for sealing a submerged surface.

In some embodiments of the third aspect of the present invention, the surface to be sealed comprises at least one surface defect to be sealed. The at least one surface defect may be selected from one or more of holes, cracks, fissures, fractures, failings of a joint, pores, punctures and the like. Alternatively or additionally, the surface defect may be a site of corrosion or weakening of the surface, which may require reinforcing by providing a seal according to the present invention.

In some embodiments of the third aspect of the present invention, the surface at least partially defines a volume in the form of a container. Containers according to the present invention may include pipes, vessels, wells, and the like. Preferably, the container volume comprises an at least partially liquid substance, and a surface of the container comprises at least one surface defect, wherein the at least one surface defect is the source of a leak from which matter comprising the at least partially liquid substance may escape. The escape of such matter may be considered to be an "active" leak. Of course, the skilled person will appreciate that in some embodiments, the at least partially liquid substance is outside of the container volume, and that where a surface defect is present, the at least partially liquid substance may penetrate through the surface defect and into the container volume.

Preferably, the surface to be sealed is at least partially submerged in an aqueous fluid. Aqueous fluids may include water, saline, sea water, mixtures of oil and water, and the like. Alternatively, the surface to be sealed may be at least partially submerged in a non-aqueous fluid, such as oil. In some embodiments of the present invention, the surface to be sealed is at least partially submerged in water, preferably submerged under water.

Advantageously, liquid bismuth alloy in liquid form has a lower melting point than the boiling point of water. As such, the liquid bismuth alloy remains in liquid form when submerged under water until it cools and becomes a solid, and furthermore does not result in the generation of steam. Similarly, bismuth alloy is not reactive with water, in contrast to, for example, liquid aluminium which reacts violently or explosively with water. As such, the metallic composition does not comprise compositions which react violently with water when in their liquid state. This may be a chemical reaction or may be due to the rapid production of steam due to the high temperature required to melt the metallic composition.

According to preferred embodiments of the third aspect of the present invention, the propellant used is steam. Where the surface to be sealed is submerged under water, advantageously, steam is directly miscible with water, yet can be provided as a stream at sufficient enough velocity to direct the liquid bismuth alloy towards the surface to be sealed.

The surface may be selected from the group consisting of: hazardous waste such as radioactive waste, nuclear waste, and biohazardous waste; oil and gas wellbores and pipelines; chemical refinery equipment; aircraft components such as aircraft fuselage and wings; military equipment; mining equipment; and marine vehicles such as submarines, ships and boats. The method of the present invention also has particular application to the maritime industry and/or to the disposal of waste in aquatic environments, where surfaces may be at least partially submerged under water. As it is particularly suitable for use in the nuclear industry, it is desirable to keep to a minimum any components which are used in a system to seal a surface since these components may become radioactive and need to be disposed of carefully. Therefore, eliminating the need for a mould or jig to hold the sealant in place whilst it solidifies reduces the amount of waste generated. However, it is possible to use the invention of the present application with a mould or jig if required.

In some embodiments, the seal is applied to repair a surface damaged by battle. For example, the seal may be applied to repair a surface damaged by one or more of bullets, missiles, shrapnel, explosives, and shaped charges, wherein optionally the surface is comprised in a fuel tank, a fuel line a radiator, or sealed space operating in a nuclear, biological, or chemical (NBC)-contaminated battlefield.

In some embodiments, the seal is applied to repair a surface comprising one or more of cracks, fissures, punctures and holes. In this way the method and apparatus of the present invention may be used to seal a leak.

In some embodiments, the seal is applied to repair a surface defect which results in a leak. In some embodiments, the leak is active, that is to say the flow of matter which comprises the leaking substance is dynamic. Advantageously, the liquid bismuth alloy can be directed towards the periphery of the surface defect that is causing the leak initially. As the liquid bismuth alloy cools and forms a solid, the surface area of the surface defect is thus at least partially reduced, thereby stemming the flow of the leak. The application of the liquid bismuth alloy may then continue to be applied to the solidified metal composition in a concentric matter, such that the surface area of the surface defect is successively reduced until a seal is formed. In preferred embodiments, the at least partially liquid metallic composition is applied to a surface defect in a spiral manner, beginning at or near to the periphery of the surface defect, and moving inwardly. The size of the surface defect causing the leak is thereby successively reduced, gradually stemming the flow of the leak until a seal is formed. Without wishing to be bound by theory, it is believed that as the surface defect is increasingly occluded, the velocity of the leak increases and the pressure decreases, according to Bernoulli's principle. It is believed that the reduction in pressure may draw the molten metallic composition into the surface defect, which subsequently cools on pre-deposited cooled and/or solidified metallic composition to seal the surface defect and provide a strong seal.

According to a fourth aspect of the present invention, there is provided a method for repairing a surface, the method comprising the steps of: providing a retaining means substantially surrounding a damaged portion of the surface, providing a metallic composition within the retaining means, heating the metallic composition to above the melting point of the metallic composition, and allowing the metallic composition to cool.

This method allows damaged surfaces to be repaired in a convenient and rapid way. The damaged surface may be, for example, a wall. The damage may be a crack which may extend partially or fully through the wall. The wall may be, for example, a concrete wall or may be a brick wall. The wall may be the wall of a tank or reservoir. The method may be for sealing a leak, preferably underwater.

The retaining means may be a mould. The retaining means serves to hold the metallic composition adjacent the damaged portion of the surface when the metallic composition is in liquid form. The molten metallic composition will enter the damaged portion of the surface and will solidify when the heating is stopped and/or where it reaches an area which is below its melting point. The retaining means may comprise a gasket or similar which is reversibly attached to the surface and surrounds the damaged portion. A plate may be provided which is configured to engage with the gasket to form a container surrounding the damaged portion of the surface. The retaining means may be unitary.

The method may further comprise removing the retaining means. Once the metallic composition has solidified, it is possible to remove the retaining means and the solidified metallic composition will remain in place.

The heating may be provided by any suitable means. In one embodiment, a heating element is provided in the cavity defined by the retaining means and the surface. The metallic composition may be provided in the form of pellets or prill that surround the heating element. As the metallic composition is melted, the liquid metallic composition will flow to the bottom of the cavity defined between the surface and the retaining means such that the cavity will be filled with liquid metallic composition over time. After sufficient time has passed to allow the liquid metallic composition to at least partially enter any cracks or cavities in the surface, the heating is stopped to allow the metallic composition to cool and solidify. The liquid metallic composition may be pressurized to force it into any cracks or recesses in the surface.

The heating element may be a resistive heating element. Alternatively or additionally, the heating element may be a pipe through which heated fluid, such as steam or water, is passed. Alternatively or additionally, the heating element may be pyrotechnical means. It will be appreciated that the heating element may also be provided outside of the cavity defined between the surface and the retaining means. The 'patch' formed by the metallic composition may be removed by simply re-heating the metallic composition.

The metallic composition may be any one of the metallic compositions described herein.

It will be appreciated that any features described in respect of one aspect of the present invention may be combined with features described in respect of another aspect of the present invention.

DETAILED DESCRIPTION

Figure 1:
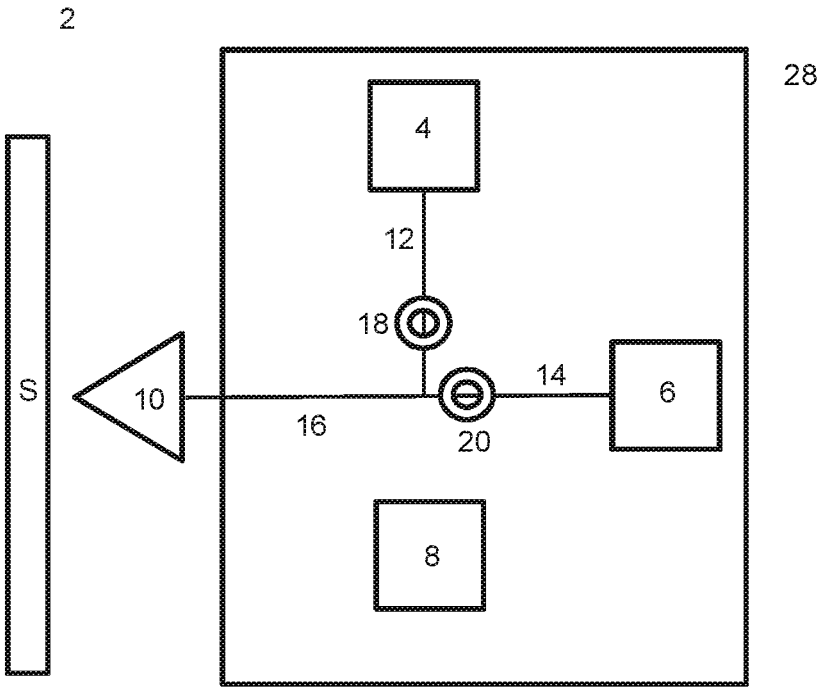
FIG. 1 is an illustration depicting an apparatus according to some embodiments of the present invention.

The present invention provides a method and an apparatus for sealing a surface, in particular for sealing a surface defect that the surface comprises. Surface defects may include holes, cracks, fissures, fractures, failings of a joint, pores and punctures which prohibit the surface from functioning correctly or leaks. For example, surfaces may develop defects, which require sealing to prevent leaks therefrom, or to stop a leak of matter emanating therefrom. Surfaces may also develop defects which require reinforcement or a protective seal. For example the surfaces of containers may become corroded or weakened during use, and require a protective seal and/or reinforcing to restore the integrity of the surface.

Surfaces that may be sealed by the present invention include, but are not limited to wooden surfaces, metallic surfaces, geological formation surfaces (e.g. stone or rock), composite surfaces (e.g. cement), and architectural surfaces. Surfaces and/or surface defects that may be sealed by the present invention also include hazardous surfaces. In particular, the present invention is relevant to sealing one or more of radioactive waste, nuclear waste and biohazardous waste. Surfaces that may be sealed by the present invention also includes oil and gas wellbores and pipelines; chemical refinery equipment; aircraft components such as aircraft fuselage and wings; military equipment; mining equipment; and marine vehicles such as submarines, ships and boats. The present invention also has particular application to the maritime industry and/or to the disposal of waste in aquatic environments, where surfaces may be at least partially submerged under water.

As used herein, the term sealing will be understood to mean one or more of filling, covering, coating, masking and/or providing a layer to a surface, and the like; and in particular may be understood to mean one or more of to a surface defect that the surface comprises. For example, a surface may comprise one or more surface defects such as a crack, fissure, hole, rupture which may require filling, covering, coating, masking and/or providing a layer thereto The term sealing will also be understood to mean providing a seal to close off the surface and/or the surface defect, such that substances are prevented from coming into contact with surface and/or surface defect, to which the seal is applied. For example, following provision of a seal to a surface defect on a surface that is submerged under water, the access of water to the surface defect would be prevented.

As used herein, the phrase sealing a surface will be understood to mean that the surface may be sealed entirely or partially. In some circumstances, it may be desirable to encapsulate the surface entirely such that the entirety of the surface is covered by a layer of metallic composition. Such surfaces may be defect free, but it is simply desired to contain the surface. Providing an encapsulating layer to a surface may be desirable, for example, when providing a containment layer to nuclear waste.

As used herein, the phrase sealing a surface defect may include sealing a surface defect which is the source of a leak. As used herein, the phrase sealing a surface defect may include sealing a surface defect which is the source of a leak from which matter comprising the leaking substance is actively escaping (an 'active' leak).

As used herein, the term fragile will be understood to mean susceptible to damage on impact with matter that is travelling at a high velocity. High velocities typically include velocities greater than 150 m/s, preferably greater than 75 m/s and more preferably greater than 50 m/s. Fragile surfaces may include, but are not limited to, metal sheets including pipes, containers and the like; geological formations such as sandstone, and composite formations such as cement, concrete, polymers, plastics, and the like. It will be appreciated that the present invention is not limited to these particular surfaces and may be applied to any surface which requires sealing.

Referring to FIG. 1, the present invention provides an apparatus (2) for applying a seal to a surface (S). The apparatus comprises a metallic composition source (4), a propellant source (6), a heat source (8) and a nozzle (10). The metallic composition source (4) and propellant source (6) are in fluid connection. As shown in FIG. 1, the metallic composition source (4) may provide a metallic composition stream (12), wherein the metallic composition stream (12) comprises metallic composition. The propellant source (6) may provide a propellant stream (14) wherein the propellant stream (12) comprises propellant. The apparatus may, in some embodiments, be provided with housing (28) which houses the aforementioned components of the apparatus, with the exception of the nozzle which preferably protrudes from the housing (28). In some embodiments, the housing (28) and the aforementioned components housed therein may be portable. For example, the housing (28) may be provided as a portable pack that can be carried by the user, and the nozzle (10) protrudes therefrom such that the user can direct the nozzle towards the surface. The apparatus may be configured for operation under water or in air.

The metallic composition stream (12) and propellant stream (14) may be configured to be in fluid connection to form a first stream (16). The first stream (16) may comprise at least partially liquid metallic composition, propellant, or a mixture thereof. A valve (18) may be provided to control the metallic composition entering the first stream (16). A valve (20) may be provided to control the propellant entering the first stream (16). The composition of the first stream (16) may be controlled by isolating the metallic composition stream (12) and/or the propellant stream (14) from the first stream (16), by means of valves (18) and (20) respectively.

The heat source (8) may be configured to provide heat to the propellant that is provided by the propellant source (6). The heat source (8) may be configured to provide heat to the metallic composition that is provided by the metallic composition source (4). The metallic composition may thus melt to provide at least partially liquid metallic composition. The heat source (8) may provide heat to one or more of the metallic composition stream (12), the propellant stream (14) and the first stream (16). The heat source may provide heat by means of thermal contact conductance, by electrical means, by pyrotechnical means, or by any other suitable method. In some embodiments, the heat source is a pyrotechnical charge.

Figure 2:
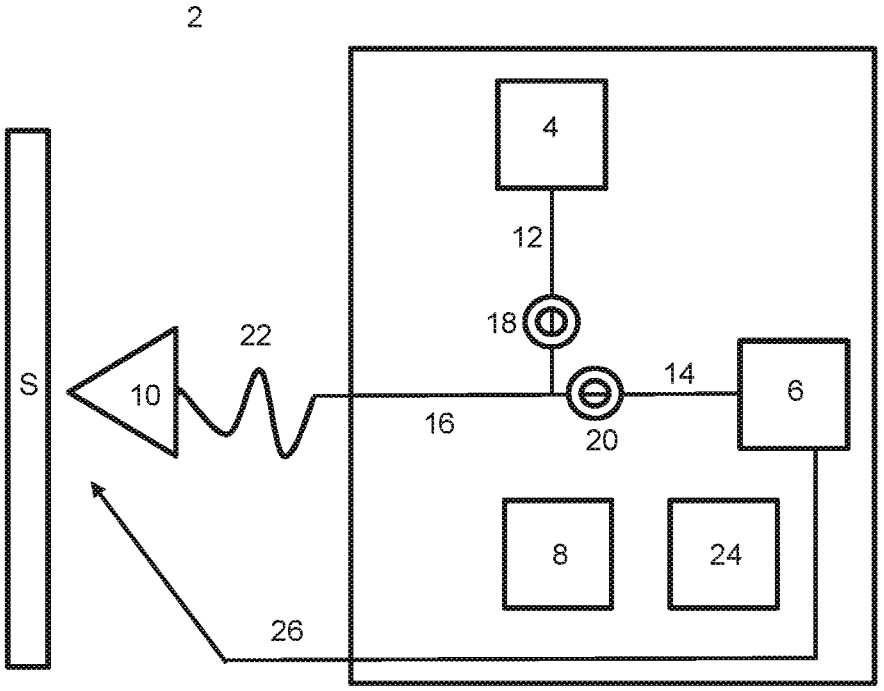
FIG. 2 is an illustration depicting an apparatus according to some embodiments of the present invention.

The nozzle (10) may be configured to be of variable position, such that different areas of the surface (S) may be sealed. For example, as depicted in FIG. 2, a hose (22), or any other suitable means, connecting the nozzle (10) to the rest of the apparatus (2) via first stream (16) may be provided, such that the nozzle (10) can be easily moved relative to the surface (S) and the rest of the apparatus (2).

The nozzle (10) is in fluid connection with the metallic composition source and/or the propellant source. Referring to FIG. 1, the nozzle (10) is shown to be in fluid connection with the metallic composition source (4) and propellant source (6) by means of the first stream (16). Referring to FIG. 2, the nozzle (10) is shown to be in fluid connection with the metallic composition source (4) and propellant source (6) by means of the first stream (16) via hose (22).

The apparatus (2) is configured to expel a stream of at least partially liquid metallic composition and/or propellant from the nozzle (10). The first stream (16) may comprise at least partially liquid metallic composition and/or propellant. The nozzle (10) may comprise a nozzle aperture (not shown) through which the first stream (16) is expelled.

The shape of the nozzle (10) and the shape of the nozzle aperture may vary depending on viscosity of the propellant used and/or the viscosity of the metallic composition to be applied to the surface. The nozzle may be any suitable shape including, but not limited to, cone-shaped, cylindrical-shaped, cuboid shaped, and arcuate shaped. The internal profile of the nozzle may also be adjusted according to the viscosity of the propellant used and/or viscosity of the metallic composition. For example, the internal angle may be more obtuse, or acute, relative to the plane defined by the nozzle aperture. The nozzle aperture may be circular, a rhombus, arcuate, or any other suitable shape. As such, it will be understood that the shape of the nozzle and aperture can be modified according to the desired application of the present invention. For example, where more viscous metallic compositions and/or more viscous propellants are employed, a wider nozzle aperture may be required. The nozzle may be made of any suitable material, including, but not limited to 3D printed polycarbonate polymer. Preferably the nozzle is cone-shaped and the nozzle aperture is located at the apex of the cone.

In some embodiments, a means for accelerating one or more of the metallic composition stream (12), the propellant stream (14) and the first stream (16), is provided. As shown in FIG. 2, in some embodiments the apparatus may further comprise one or more pumps (24) configured to accelerate the first stream (16), such that the first stream (16) is expelled from the apparatus via nozzle (10) at a desired velocity. Pump (24) may also be configured to accelerate the propellant stream (14) and/or the metallic composition stream (10). The pump (24) may be an electric pump, or any other suitable means. In some embodiments, the propellant provides sufficient propulsion to accelerate one or more of the metallic composition stream (12), the propellant stream (14) and the first stream (16) independently. The propellant may be under pressure, such that when a valve is opened, the pressurised propellant is able to pass through the valve and exit the apparatus.

In some embodiments, the apparatus expels metallic composition such that the metallic composition is applied to the surface at low velocity. Surfaces may be fragile and susceptible to damage if metallic compositions are applied at high velocities. The velocity at which the first stream (16), comprising the at least partially liquid metallic composition and/or propellant, is expelled from the nozzle may depend on the configuration of the apparatus. For example, the exit velocity of the first stream (16) from the apparatus may depend on one or more of the flow rate of the first stream (16), the propulsion provided by the propellant, the diameter of the fluid connections within the apparatus (e.g. the diameter of first stream (16), hose (22), propellant stream (14)), the shape of the nozzle (10), the shape of the nozzle aperture, and in embodiments, the strength of accelerating means (e.g. pump (24)).

On application of the at least partially liquid metal composition to the surface, the metal composition may begin to cool and solidify. The at least partially liquid metallic composition may also heat the surface. Preferably, the at least partially liquid metallic composition is applied to the surface with sufficiently low velocity that the metal and/or metal alloy cools on contact with the surface. The partially liquid metallic composition exiting the apparatus may thus be in contact with the cooler metal already deposited on the surface, and as such a constant stream of metallic composition may be administered.

The metallic composition may be selected such that the at least partially liquid metallic composition rapidly solidifies and cools on the surface to which it is applied, and thus thermal damage to the surface is reduced. Advantageously, rapid cooling and solidification of the liquid metal composition which is applied to the surface means that the liquid metal composition does not drip from the surface to which it is applied under the force of gravity. As such, the metallic composition sealant may be applied directly to a surface that is vertical, horizontal, curved, round, or at any other angle, relative to the plane of the ground.

Preferably, the metallic composition expands when it reaches the solidification isotherm i.e. when the metallic composition cools from a liquid to a solid following application to a surface. The expansion of metallic compositions on solidification is contrary to most typical metals which contract on solidification and further cooling. The expansion of the metallic composition on cooling or solidifying results in the metallic composition exerting pressure on the crack, fissure, hole, or other suitable surface, such that the metallic composition is trapped therein. In some embodiments, the metallic composition does not expand or contract on cooling or solidifying. In other embodiments, the metallic composition may contract on cooling or solidifying.

Preferably, the solidification isotherm of the metallic composition is such that the liquid metallic composition rapidly cools on contact with the surface, and as such does not drip or flow through a crack, fissure or hole on a surface as a liquid. Metallic compositions with suitable solidification isotherms may comprise and/or be bismuth and/or bismuth alloys.

To control the solidification isotherm, the metallic composition may be administered to the surface at a sufficiently high temperature, and with sufficient heat capacity, to melt the surface of the already deposited metallic composition. Advantageously, the metallic composition that has been administered to the surface may coalesce with previously deposited metallic composition on the surface, and solidify. By melting only the surface of deposited metallic composition, a series of layers may be built up to form a layer of increased thickness. Therefore, advantageously, the metallic composition sealant provided to a surface according to the present invention is not a sinter i.e. it is not provided by the process of compacting and forming a material through pressure, but is in fact provided as a constant stream of metallic composition dictated by constant cooling and heating. Thus a seal to a leaking hole in a container containing a fluid may also be provided, wherein the metallic composition solidifies first on the periphery of the hole, and subsequent layers build up through melting, coalescing and solidifying of the deposited metallic composition. As such, the diameter of the hole is narrowed until it is entirely sealed. Advantageously, the metallic composition may penetrate through the leaking hole into the container, thus providing a seal to the hole from the inside of the container. Thus, advantageously, the pressure of the fluid within the container may be exerted against the solidified metallic composition seal to further strengthen the seal formed.

As depicted in FIG. 2, in some embodiments, a further stream (26) of heated propellant may be directed towards the surface and the deposited metallic composition, during application of at least partially liquid metallic composition. Advantageously, in this way, the cooling or solidifying of the liquid metallic composition can be highly controlled during application to the surface.

In some embodiments, the metallic composition seal once cooled and/or solidified on the surface is heat treated. Heat treating the metallic composition seal may provide a smooth coating surface. Advantageously, the smooth coating provided can be wiped clean. This is particularly advantageous in industries where cleanliness of the coated surface is important.

Preferably, the propellant applies sufficient pressure (for example, hydraulic pressure) to advantageously force the metallic composition deep into cracks, fissures or holes on the surface to be sealed, for example, where the surface to be sealed is in a subterranean formation or fractured cement block. Preferably, the propellant applies sufficient pressure to the metallic composition whilst it is still liquid, thus the metallic composition solidifies only in locations sufficiently cool. Other sealants, for example cement, cannot penetrate deeply into such cracks, fissures or holes because fine particles therein form a filtration surface. Advantageously, metallic compositions according to the present invention can provide good tenacity deep within cracks, fissures or holes, affording greater integrity to the overall seal provided.

The propellant may be steam and may be super-heated. In some preferred embodiments, the propellant is steam and the at least partially liquid metallic composition is delivered underwater. Advantageously, the steam propels the at least partially liquid composition rapidly and directly to the surface. Advantageously the steam may clean cracks by removing particulates prior to application of the metal and/or metal alloy. Advantageously, the penetrating metallic composition may remove particulates from the surface as it is applied thereto.

Advantageously, a steam propellant forms no bubbles during application of the at least partially liquid metallic composition where the surface to be sealed is underwater. Bubbles may undesirably cause the metallic composition to separate into its constituent metals. Furthermore a lack of bubbles prevents the metallic composition from forming an aerosol, which may disrupt the water between the nozzle and the surface. The lack of bubbles therefore also allows the user to clearly see the surface to which the metallic composition is to be applied. In addition, bubbles may cause particulates to be carried to the surface of the water, which is particularly undesirable if said particulates are hazardous (e.g. radioactive particles). Advantageously, the steam simply condenses when it comes into contact with the water surrounding the surface, without the formation of any by-products, or possibly environmentally hazardous compounds. Furthermore, advantageously, the use of steam in underwater applications results in an area of localised heat about the nozzle of the apparatus, thereby ensuring that the at least partially liquid metallic composition does not solidify too rapidly.

By providing heated propellant, the location on the surface where the at least partially liquid metallic composition begins to solidify can be controlled. As such, the morphology and casting of the metallic composition seal can be manipulated according to the surface to be sealed.

In preferred embodiments, the heated propellant is steam and the surface to be sealed is underwater, wherein the solidification isotherm of the at least partially liquid composition is controlled such that the initially deposited metallic composition (i.e. the leading sealant) cannot extend into regions of the surface with a local temperature less that the melting point of the metallic composition. As such, molten metal can advantageously be deposited to underwater surfaces, without the molten metal dripping away from the surface to which it is deposited under the influence of gravity. In some embodiments, the at least partially liquid metallic composition is directed into a mould to control the morphology of the seal provided on the surface. For example, the metallic composition may be denser than water, and sink to the bottom of a mould to control the morphology of the seal. A mould may be provided around a leaking surface, for example, a crack in a concrete pond through which water is leaking. The at least partially liquid metallic composition directed into the mould may be in the form of prill and may be heated by means of steam or electrical means or pyrotechnical means. The at least partially liquid metallic composition may heat the concrete and may cross the solidification isotherm to provide a seal on cooling or solidifying.

In some embodiments, the propellant is air. Preferably the air is heated. Preferably the air is compressed. It has been surprisingly found that, advantageously, compressed air may be used as a propellant to deliver at least partially liquid metallic compositions to a surface under dry conditions. Without wishing to be bound by theory, under dry conditions, it is thought that the solidification isotherm is much more localized, compared to submerged conditions. As such, more localized control of the surface of deposited metallic composition on a surface, melting and coalescing with at least partially liquid metallic composition being applied, can be achieved.

The propellant may alternatively be a noble gas, preferably argon.

The metallic composition comprises a metal, a metal alloy or a combination thereof. In some embodiments the metal composition is a metal. In some embodiments the metal composition is a metal alloy. The metal alloy may be selected from the group consisting of bismuth alloys, antimony alloys, tin alloys, lead alloys, gallium alloys, indium alloys, thallium alloys, zinc alloys, cadmium alloys, mercury alloys, copper alloys, silver alloys, gold alloys, nickel alloys, palladium alloys, platinum alloys, cobalt alloys, rhodium alloys, iridium alloys, iron alloys, ruthenium alloys, osmium alloys, or mixtures thereof.

Preferably the metal alloy is a bismuth alloy. Suitable bismuth alloys include, but are not limited to Field's Metal and Wood's Metal.

The metal may be selected from the group consisting of bismuth, antimony, tin, lead, gallium, indium, thallium, zinc, cadmium, mercury, copper, silver, gold, nickel, palladium, platinum, cobalt, rhodium, iridium, iron, ruthenium and osmium. Preferably the metal is bismuth.

Excipients such as, but not limited to, silica, may be added to the metallic composition.

The metal composition may be selected based on the desired application. Preferably a metallic composition is selected which does not chemically react with the propellant. Preferably the metallic composition is resistant to oxidation. More preferably, the metallic composition selected is resistant oxidation in water and/or resistant to oxidation in air. Advantageously, as the metallic composition is delivered to the surface, no oxidation film forms, and thus a constant stream of un-oxidised metal alloy is delivered to the surface. Preferably the metallic composition is resistant to reaction with the surface material to which it is applied.

The metallic composition can be optimised for specific applications. For example, specific metallic compositions may be used to provide a seal which affords one or more of good corrosion resistance, protection against radiation, good tensile strength, specific deformation properties (creep), malleability, and such like. Metallic compositions may also be optimised to control the viscosity of the at least partially liquid metal composition during application to a surface, wherein said viscosity may be temperature and/or pressure dependent. In some embodiments, it may be desired to provide a metallic composition seal which at a determined temperature range and/or determined pressure range, the metallic composition which forms the seal on the surface becomes liquid, and thus the seal is removed. In some embodiments, it may be desired to provide a metallic composition seal that is soft, such that the metallic composition seal can be easily removed. The metallic composition may be modified to increase or reduce the affinity of the metal composition for itself, or alternatively to increase or reduce the mechanical tenacity of metallic composition sealant once solidified.

Advantageously the metallic compositions of the present invention may be recycled. As the metallic compositions are preferably resistant to oxidation and/or reaction with the surface to which they are applied, the metallic composition may be re-used if desired. The metallic composition seal may be removed from a surface by, for example, heating the composition to re-form at least partially liquid metallic composition, or forcibly breaking the seal away from the surface.

In some embodiments, the apparatus and methods according to the present invention may be useful for entrainment of flux. The entrainment of flux may facilitate soldering onto suitable engineered surfaces, such as, but not limited to aluminium, steel, stainless steel and copper. Any suitable flux may be used.

In some embodiments, the apparatus and methods according to the present invention may be useful for coating reinforced concrete. An electric current may be applied to the coating and to the concrete interior through metal rebar to drive out impurities (or water-electro-osmosis) or to provide cathodic protection of the rebar (impressed current).

Figure 3:
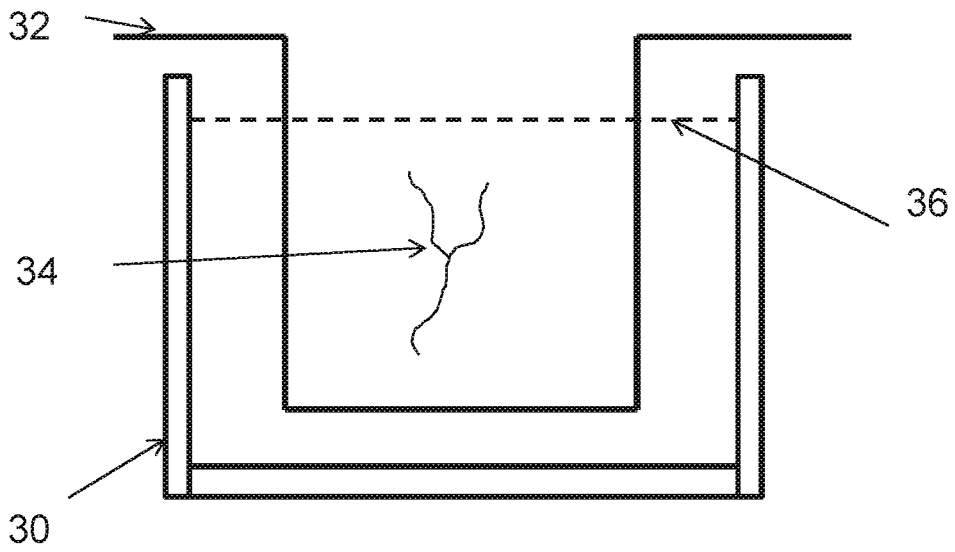
FIG. 3 is a schematic illustration of the method according to the fourth aspect of the present invention.

FIG. 3 depicts a crack 34 in a surface being repaired in accordance with the fourth aspect of the present invention. A frame 30, which may be a gasket, is provided and surrounds the crack 34. A plate (not shown) is also provided which engages with the frame 30 to define a cavity between the plate and the surface. Metallic composition in the form of pellets is provided in the cavity. A heating element 32 which passes through the cavity is also provided. The heating element 32 provides heat to the metallic composition within the cavity and causes it to melt. The cavity fills within molten metallic composition until the level of the molten metallic composition 36 is higher than the damaged portion of the surface. In this way, the damaged portion of the surface is covered with molten metallic composition. The molten metallic composition enters any cracks or cavities in the damaged portion and is allowed to solidify, thereby providing a 'patch' to the damaged portion. It will be appreciated that the metallic composition could be added to the cavity defined between the retaining means and the surface according to the method or apparatus of the first and second aspects of the present invention.

EXPERIMENTS

The following examples are intended to exemplify embodiments of the invention. In no way are the following examples to be construed as limitations to the claims or scope of the invention.

Materials and Methods

Field's metal=eutectic alloy 32.5% Bi/51% In, 16.5% Sn; m.p. 62° C.

Wood's metal=eutectic alloy 50% Bi/26.7% Pb, 13.3% Sn; 10% Cd m.p. 70° C.

Example 1—Sealing of a Fragile Surface

An egg was selected as an exemplary fragile surface. An egg was clamped in an upright position on a rotating base, at room temperature. White Tack® (UHU) was used at the positions on which the egg was clamped. The egg was allowed to equilibrate to ambient temperature (approximately 20° C.). Field's metal was selected as the metallic composition sealant. Air was selected as the propellant. The air propellant was heated and contacted with Field's metal to form a stream of liquid Field's metal and heated air. The resulting liquid Field's metal stream was accelerated towards the egg at a velocity of less than 50 m/s, and directed towards the egg surface via a nozzle. As the Field's metal contacted the surface of the egg, the rotating base to which the clamp was secured was rotated such that all sides of the egg were covered with liquid Field's metal. The sealed egg was then allowed to cool. It was noted that dipping an egg into a pool of liquid Field's metal did not result in the metal adhering to the surface, but the application of the metal in a liquid spray form allowed a coating of the metal to be applied to the surface of the egg. As such, the present invention allows the application of metallic compositions to surfaces which would not be possible by simple immersion in liquid metallic composition.

Example 2—Deposition of a Seal without Thermal Damage

To demonstrate the lack of heat-induced damage to the surface, and also the rapid cooling of the deposition of the metallic composition, a sealed egg according to Example 1 was impacted with a sharp edge. It was noted that contacting the Field's Metal sealant with the sharp edge resulted in burnishing of the sealant. The sealant was found to have excellent tensile strength, and could not be removed from the egg surface by force.

The White Tack® (UHU) was removed to reveal a portion of the underlying egg shell. The egg shell was broken at this position. The inside of the egg was found to be liquid, and thus had not been subject to thermally induced precipitation i.e. had not cooked. It was therefore determined that the Field's metal sealant rapidly cools on contact with the egg surface, and thus thermal damage to the surface is avoided.

Example 3—Deposition of a Seal with High Pressure Resistance

The egg was removed from the clamp, the White Tack® removed, and the remaining exposed portions of egg shell sealed with Field's metal as described in Example 1.

To demonstrate that the seals according to the present invention are resistant to elevated pressures (i.e. do not break under increased pressure), an egg according to Example 1 was treated under high pressure. A pressure fitting that had been fitted to the egg before coating was used to pressurise the egg up to a pressure of 70 psi (twice the pressure of a standard car tyre). The sealant was found to be robust and did not shatter.

Example 4—Deposition of a Seal to a Crack in a Concrete Surface

A cracked concrete paving slab was selected as an exemplary cracked surface. Field's metal was selected as the metallic composition sealant. Air was selected as the propellant. The air propellant was heated, and contacted with Field's metal to form a stream of liquid Field's metal and heated air. The resulting liquid Field's metal stream was accelerated towards the concrete surface and directed towards the concrete surface via a nozzle. The liquid Field's metal was observed to solidify on contact with the concrete surface. The resulting sealed crack was allowed to cool to ambient temperature. The resulting seal was found to be highly tenacious with the crack and the surrounding surface. A seal of approximately 3.5 mm was provided.

Example 5—Deposition of a Seal to a Crack in a Concrete Surface and Maintaining the Temperature of the Sealant in the Crack Before Cooling A cracked concrete paving slab was selected as an exemplary cracked surface. Field's metal was selected as the metallic composition sealant. Air was selected as the propellant. The air propellant was heated and contacted with Field's metal to form a stream of liquid Field's metal and heated air. The resulting liquid Field's metal stream was accelerated towards the concrete surface and directed towards the concrete surface via a nozzle. The temperature of the liquid Field's metal was maintained once applied to the surface, by means of a heated propellant stream directed directly towards the application area, to ensure a smooth application of the liquid Field's metal to the cracked surface. Without wishing to be bound by theory, it is thought that maintaining the temperature of the Field's metal within the crack on cooling provides a more favourable solidification isotherm. The resulting sealed crack was allowed to cool to ambient temperature. The resulting seal was found to be highly tenacious with the crack and the surrounding surface. A seal of approximately 3.5 mm was provided.

Example 6—Deposition of a Seal to a Crack with High Pressure Resistance

To demonstrate that the seals applied to cracks according to the present invention are resistant to elevated pressures (i.e. do not break under increased pressure), the sealed cracked concrete surfaced according to Example 5 was treated under high pressure. The sealed cracked concrete surface was placed in a pressurised chamber and exposed to pressures of up to 70 psi (approximately 5 bar). The sealant was found to be robust and did not break away from the concrete surface up to these pressures.

Example 7—Deposition of a Seal to a Cracked Surface in Submerged Conditions

A cracked concrete paving slab was selected as an exemplary cracked surface, and submerged under water. Field's metal was selected as the metallic composition sealant. Steam was selected as the propellant. The steam propellant was heated and contacted with Field's metal to form a stream of liquid Field's metal and steam. The resulting liquid Field's metal stream was accelerated towards the concrete surface, and directed towards the concrete surface via an underwater nozzle. The nozzle was held in a fixed position, and the crack moved relative to the nozzle. The high specific heat capacity (SHC) of water resulted in heat being quickly dissipated from the liquid Field's metal underwater. It was found that the liquid Field's metal solidified as soon as it was deposited in the crack via the steam propellant. The resulting sealed crack was allowed to cool underwater, and the sealed concrete surface removed from the water. The resulting seal was found to be highly tenacious with the crack and the surrounding surface.

Example 8—Deposition of a Seal to a Cracked Surface in Submerged Conditions and Preheating the Surface to be Sealed A cracked concrete paving slab was sealed with Field's metal according to Example 7. Prior to deposition of the seal to the crack, the crack was pre-heated with the steam propellant. The preheated crack, and the resulting increase in the temperature of the ambient water temperature surrounding the crack, resulted in a more uniform, more tenacious and improved quality seal. Without wishing to be bound by theory, it is thought that applying steam to the surface before applying the liquid Field's metal to the surface, results in a more favourable solidification isotherm for cooling of the Field's metal.

Example 9—Deposition of a Seal to a Hole in a Leaking Container

In view of the results observed in Example 4, namely that the sealant solidified on contact with the cracked concrete surface, it was hypothesized that the present invention could be used to seal a leaking hole, wherein flow of a fluid is exiting the hole at the time of applying the sealant thereto.

A metallic cylinder filled with water was shot with a .22 rifle to create a dynamic leak. Field's metal was selected as the metallic composition sealant. Air was selected as the propellant. The air propellant was heated and contacted with Field's metal to form a stream of liquid Field's metal and heated air. The resulting liquid Field's metal stream was accelerated towards the hole in the container and directed towards the hole via a nozzle. The liquid Field's metal was observed to preferentially solidify at the periphery of the leaking hole, and with further application, continued to narrow the hole until the hole was entirely sealed. The liquid Field's metal was further observed to penetrate through the hole into the container at the site of damage, and to extend slightly beyond the periphery of the original hole size. Thus the penetration of the liquid Field's metal into the hole provided a "plug" like effect, wherein the pressure of the fluid therein pressed against the "plug"-like portion of the seal to secure it in place and provide additional sealing effects through pressure. The resulting seal was found to be highly tenacious with the surrounding surface and to completely seal the hole.

In summary, the method and apparatus of the present invention provides the ability to quickly and effectively seal a surface under a number of conditions. The surface to be sealed may be located in air or under water. The application of a spray of liquid metallic composition allows the metallic composition to adhere to surfaces which the metallic composition would not otherwise adhere.

The invention claimed is:

1. A method of sealing a surface to be sealed comprising:
providing a metallic composition, the metallic composition consisting of a metal or a metal alloy;
providing a propellant;
heating the metallic composition to above the melting point of the metallic composition to provide at least partially liquid metallic composition;
accelerating the at least partially liquid metallic composition towards the surface to be sealed by means of the propellant;
applying the at least partially liquid metallic composition to the surface to be sealed,
wherein the surface at least partially defines a volume defining a container, wherein the container comprises an at least partially liquid substance, and
wherein the surface to be sealed comprises at least one surface defect to be sealed, the at least one surface defect is the source of an active leak from which matter comprising the at least partially liquid substance is escaping and the propellant provides sufficient propulsion to force the at least partially liquid metallic composition into the at least one surface defect and seal the surface defect when applying the at least partially liquid metallic composition to the surface.

2. The method according to claim 1, wherein the surface to be sealed is at least partially submerged in an aqueous fluid, optionally wherein the surface is submerged under water.

3. The method according to claim 1, wherein the method further comprises the step of heating the propellant.

4. The method according to claim 3 wherein the metallic composition is heated by contacting the metallic composition with the heated propellant.

5. The method according to claim 1, wherein the metallic composition is heated otherwise than by contact with a heated propellant.

6. The method according to claim 1, wherein both the metallic composition and the propellant are heated.

7. The method according to claim 1, further comprising the steps of:
(i) accelerating the propellant towards the surface to be sealed; and
(ii) contacting the propellant with the surface to be sealed;
prior to accelerating the at least partially liquid metallic composition towards the surface to be sealed.

8. The method according to claim 1, further comprising the steps of:
(i) providing a separate stream of heated propellant; and
(ii) directing the separate stream of heated propellant towards the surface during application of the at least partially liquid metallic composition to the surface.

9. The method according to claim 1, wherein the at least partially liquid metallic composition cools on contact with the surface to form a solid metallic composition seal.

10. The method according to claim 9 wherein the at least partially liquid metallic composition is applied to the surface as a constant stream.

11. The method according to claim 10 wherein the at least partially liquid metallic composition at least partially melts previously applied solid metallic composition, coalesces with the previously applied solid metallic composition, and cools to form solid metallic composition.

12. The method according to claim 1, wherein the at least partially liquid metallic composition is at a temperature no greater than 200° C.

13. A method according to claim 12, wherein the at least partially liquid metallic composition is at a temperature no greater than 100° C. when it is accelerated towards the surface.

14. The method according to claim 1, wherein the at least partially liquid metallic composition is accelerated towards the surface at a velocity no greater than around 100 m/s.

15. A method according to claim 14, wherein the at least partially liquid metallic composition is accelerated towards the surface at a velocity no greater than around 50 m/s.

16. A method according to claim 15, wherein the at least partially liquid metallic composition is accelerated towards the surface at a velocity no greater than around 25 m/s.

17. The method according to claim 1, wherein the at least one surface defect comprises one or more of cracks, fissures, punctures, and holes.

18. The method according to claim 1, wherein the propellant cleans and/or heats the surface to be sealed before the at least partially liquid metallic composition is applied.

19. The method according to claim 1, wherein the propellant is selected from the group consisting of steam or air.

20. The method according to claim 1, wherein the propellant is steam.

21. The method according to claim 1, wherein the metallic composition consists of a metal alloy.

22. A method according to claim 21, wherein the metal alloy is selected from the group consisting of bismuth alloys, antimony alloys, indium alloys, tin alloys, lead alloys and gallium alloys.

23. A method according to claim 22, wherein the metal alloy consists of a bismuth alloy.

* * * * *